US008827753B2

(12) United States Patent
Neumann et al.

(10) Patent No.: US 8,827,753 B2
(45) Date of Patent: Sep. 9, 2014

(54) INSERTION CONTACT FOR ARRANGEMENT AT A CONTACT SUPPORT

(71) Applicant: Lumberg Connect GmbH, Schalksmuehle (DE)

(72) Inventors: Wolfgang Neumann, Minden (DE); Dirk Pfaffenbach, Halver (DE); Frank Umbach, Hagen (DE)

(73) Assignee: Lumberg Connect GmbH, Schalksmuehle (DE)

( * ) Notice: Subject to any disclaimer, the term of this patent is extended or adjusted under 35 U.S.C. 154(b) by 83 days.

(21) Appl. No.: 13/788,229

(22) Filed: Mar. 7, 2013

(65) Prior Publication Data

US 2013/0244507 A1 Sep. 19, 2013

(30) Foreign Application Priority Data

Mar. 13, 2012 (DE) ..... 10 2012 004 833

(51) Int. Cl.

| | |
|---|---|
| ***H01R 4/48*** | (2006.01) |
| ***H01R 13/11*** | (2006.01) |
| ***H01R 12/72*** | (2011.01) |
| ***H01R 12/50*** | (2011.01) |

(52) U.S. Cl.

CPC ..... *H01R 23/7068* (2013.01); *H01R 13/112* (2013.01); *H01R 12/721* (2013.01)

USPC ..... 439/828

(58) Field of Classification Search

CPC ..... H01R 23/7068; H01R 12/721; H01R 13/112; H01R 12/16; H01R 4/48

USPC ..... 439/828, 404, 405

See application file for complete search history.

(56) References Cited

U.S. PATENT DOCUMENTS

| | | | | |
|---|---|---|---|---|
| 6,932,659 | B1 | 8/2005 | Wong | |
| 7,997,941 | B2 * | 8/2011 | Pfaffenbach et al. | 439/680 |

FOREIGN PATENT DOCUMENTS

| | | | |
|---|---|---|---|
| DE | 4034094 | * | 5/1991 |
| DE | 10 2008 054 015 | * | 5/2010 |
| EP | 1148587 | A2 | 10/2001 |
| WO | WO 2009/090753 | A1 | 7/2009 |

* cited by examiner

*Primary Examiner* — Javaid Nasri

(74) *Attorney, Agent, or Firm* — Von Rohrscheidt Patents

(57) ABSTRACT

The invention relates to an insertion contact for arrangement at a contact support including an opposite contact, the insertion contact including a contact arm which contacts a first contact surface of an opposite contact in an electrically conductive manner which opposite contact is arranged on a top side of a contact support; a support arm which contacts a bottom side of the contact support; and a connection arm which arranges the contact arm at the support arm, wherein the contact arm and/or the support arm is deflectable in a spring elastic manner, wherein the insertion contact includes a connection member for connecting a conductor, wherein the insertion contact is configured as a stamped component. It is an object of the invention to provide insertion contacts which facilitate reducing grid pitches of plug connectors, in particular according to Rast 2.5 standard, while maintaining predetermined technical specifications.

9 Claims, 5 Drawing Sheets

INSERTION CONTACT FOR ARRANGEMENT AT A CONTACT SUPPORT

RELATED APPLICATIONS

This application claims priority from and incorporates by reference German patent application DE 10 2012 004 833.5, filed on Mar. 13, 2012.

FIELD OF THE INVENTION

The invention relates to an insertion contact for arrangement at a contact support including an opposite contact, the insertion contact including a first contact arm which contacts a first contact surface of the opposite contact arranged at a top side of the contact support and which first contact arm includes a support arm which contacts a bottom side of the contact support and a connection arm which arranges the contact arm at the support arm, wherein the contact arm and/or the support arm are deflectable in a spring elastic manner and wherein the insertion contact includes a connection member for connecting a conductor and wherein the insertion contact is configured as a stamped component.

BACKGROUND OF THE INVENTION

Insertion contacts of similar types are known from many applications. Two examples are DE 10 2008 054 015 or DE 4034094 C2 owned by applicant. These are so-called double-side effective insertion contacts which are pushed onto a contact support like clamps from opposite sides. For an insertion contact of this type there are many types of opposite contacts supported at the contact supports. Without inferring any limitation, the invention is subsequently described and illustrated based on a contact support configured as a printed circuit board, whose contact surfaces contacted by the insertion contact are configured by conductive paths.

Accordingly, the recited preexisting applications by applicant illustrate a so-called direct insertion contact which is pushed onto an edge of a circuit board. The insertion contacts of the plug connector establish an electrical connection with the conductive paths arranged at an edge of the circuit board. Such plug connectors are designated as direct plug connectors since they directly engage the circuit board and omit intermediate contacting through a separate contact support arranged on the circuit board, wherein the opposite contacts of the contact support are connected with the conductive paths. The conductive paths representing the opposite contacts and also the insertion contacts themselves are typically plated with so-called finishing layers which significantly improve electrical transmission values.

The insertion contacts supported in the contact support are typically configured as stamped components or as stamped and bent components and are consequently provided in two different embodiments. On the one hand side, insertion contacts are known which contact the contact surfaces of the opposite contacts, thus the conductive paths with a stamped surface also designated as stamped edge. Insertion contacts of this type have a great advantage in that they can impart high contact forces since contact- and support arms are not very elastic and are therefore suited for transmitting high currents. These insertion contacts also bear the risk of damaging the finishing layers due to the typically burred and rough stamping edge in combination with high contact forces during insertion on the conductive paths. This counteracts the effect of the high contact forces by degrading the electrical transmission values by destroying or damaging the finishing layers.

A second type of plug contacts which are typically configured as stamped and bent components is deformed after stamping, so that the so-called rolling sides contact the contact surfaces of the conductive paths. Such contacts apply small contact forces to the contact surfaces compared to comparable contacts that contact with their stamped edges. However, they are suitable in a reinforced configuration or using additional springs augmenting the contact force (c.f. DE 4034094 C2, cited supra) in order to impart higher contact forces without damaging the finishing layers during insertion which is due to the rolled surface structure. Additionally, the surface finishing of the contact arms can be applied in a controlled manner in the mutual contact area of insertion contact and opposite contact, whereas the stamped contacting typically at least requires a complete finishing of the stamped edge, typically, however, of the entire contact.

For an advantageous rolled surface contacting the opposite contacts there are certain limits to miniaturization in order to provide the required degree of contact forces. Thus, in particular, the grid dimensions of plug connectors according to the Rast 2.5 standard are not easily reducible while maintaining the respective technical features. Still, there is an increasing requirement to implement an increased pole number for predetermined current transfer requirements and electrical transmission values.

BRIEF SUMMARY OF THE INVENTION

Consequently, it is an object of the invention to provide insertion contacts through which the grid pitches of plug connectors, in particular according to Rast 2.5 standard, can be reduced while maintaining required technical features.

The invention is implemented by an insertion contact for arrangement at a contact support including an opposite contact, the insertion contact including a contact arm which contacts a first contact surface of an opposite contact in an electrically conductive manner which opposite contact is arranged on a top side of a contact support; a support arm which contacts a bottom side of the contact support; and a connection arm which arranges the contact arm at the support arm, wherein the contact arm and/or the support arm is deflectable in a spring elastic manner, wherein the insertion contact includes a connection member for connecting a conductor, wherein the insertion contact is configured as a stamped component, wherein the contact arm of the insertion contact contacts the first contact surface of the opposite contact with a rolled side of the contact arm, and wherein the support arm contacts the bottom side of the contact support with a stamped edge of the support arm.

The essential advantage of the invention lies in the configuration of the support arm contacting the contact support with the stamped side of the support arm, wherein the printed circuit board is the contact support in the illustrated embodiment. Compared to conventional insertion contacts which contact a contact surface of the opposite contact with a rolled side while the support arm also contacts with a rolled side, the contact width of the support arm according to the invention is significantly lower and thus only corresponds to the material thickness of the contact. When there is a respective requirement, the support arm that is relatively inflexible compared to known devices can be used for increasing the contact forces between the contact arm and the contact surface. An alternating opposite arrangement of plural insertion contacts adjacent to one another causes the contact arm of the insertion contact to contact a contact surface on the top side of the contact support with a rolled side of the insertion contact, whereas the adjacent second insertion contact contacts the contact surface on the bottom side of the contact support with the contact arm of the insertion contact. Since the support arm of the insertion contact according to the invention is much narrower than the associated contact arm, the insertion contacts can be nested into one another at the contact support through an alternating arrangement of insertion contacts according to the invention, so that opposite contact arms are separated by the contact support and arranged overlapping.

In one embodiment, it is provided that the connection arm is arranged at an edge of the contact arm and oriented essentially orthogonal to the contact arm with the rolled side of the connection arm. In this embodiment, due to the arrangement of the connection arm, also the support arm is arranged laterally of the contact arm and below the contact arm, so that a maximum amount of overlap of adjacent contact arms is provided for an opposed arrangement of plural contacts at a contact support. Arrangements are also feasible that have an angle that differs from 90°.

However, an insertion contact is preferred in particular, wherein the insertion contact is characterized in that the connection arm is configured elbowed and the support arm arranged at the connection arm is oriented parallel to the longitudinal center axis of the contact arm and centrally below the contact arm.

For this insertion contact, the arrangement of the support arm parallel to the longitudinal center axis and centrally below the contact arm provides an essentially even distribution of the contact forces between the contact surfaces of opposite contact and contact arm.

It is furthermore provided that the contact arm supports the connection member, in particular a cutting fork. It is also feasible that the connection member is configured as a crimped connection spring clamp, screw clamp, solder joint or as a different connection type in order to connect the conductor.

It is furthermore feasible that the opposite contact forms a second contact surface below the contact support, wherein the second contact surface is electrically connected with the support arm. This embodiment contacts the opposite contact on both sides in an electrical manner which provides advantages with respect to electricity transmission.

Improving upon the recited known insertion contacts, it is another object of the invention to provide an arrangement for insertion contacts which facilitates a reduced grid dimension, thus a reduced distance between the contact points of two adjacent insertion contacts.

This object is achieved by an arrangement according to the features of claim 6 which is in particular characterized in that the contact arms of the insertion contacts are arranged at the contact support opposite from one another so that the first insertion contact contacts the upper contact surface of the first opposite contact with its contact arm and the second insertion contact contacts the lower contact surface of the second opposite contact with the contact arm of the insertion contact.

This arrangement facilitates the nesting of similar insertion contacts according to the invention described supra at a contact support and a reduction of the grid pitch.

In particular, the contact surfaces of the bottom side of the contact support are arranged offset relative to the contact surfaces of the top side of the contact support by a certain fraction of the offset, the grid pitch of plug connectors can be substantially reduced through insertion contacts according to the invention.

Thus it is provided that the distance of the top side contact surfaces and the bottom side contact surfaces are identical.

In particular when the offset corresponds to 0.5 times the distance, an advantageous insertion contact with the features of claim 3 can be used which facilitates a significant reduction of known grid pitches of plug connectors. This facilitates in particular for initially recited and widely used plug connectors according to Rast 2.5 standard to substantially reduce the grid pitch for identical technical values which provides a substantial miniaturization in practical applications. It is particularly advantageous when the contact surfaces of the top side opposite contacts are positioned approximately centrally relative to the contact surfaces of the bottom side opposite contacts.

BRIEF DESCRIPTION OF THE DRAWINGS

Additional advantages of the invention can be derived from the subsequent detailed description of an embodiment with reference to drawing figures, wherein.

DETAILED DESCRIPTION OF THE INVENTION

Figure 2:
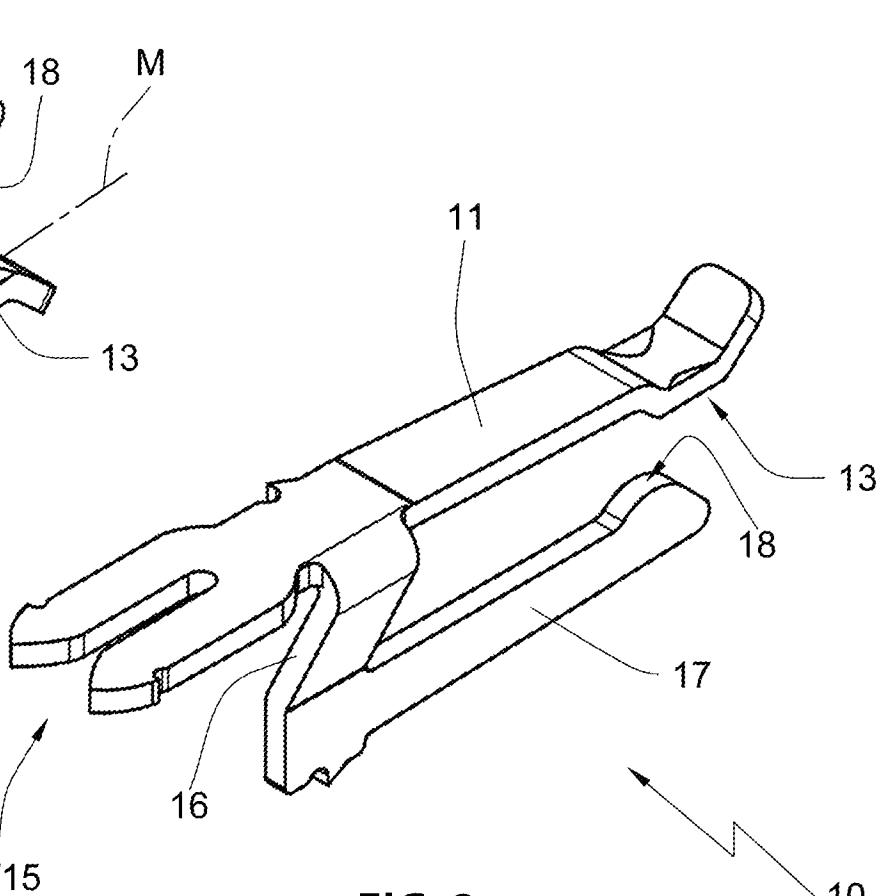
FIG. 2 illustrates the insertion contact according to FIG. 1 in a perspective view of the top side of the contact arm.

In the figures, an insertion contact according to the invention is designated with the reference numeral 10. The insertion contact 10 is illustrated by itself in FIGS. 1 and 2. It includes a contact arm 11 whose bottom side oriented towards a contact support 12 forms a contact protrusion 13. A connection member 14 configured as a cutting fork 15 is arranged at an end of the contact arm 11 that is oriented away from the contact protrusion 13. A connection arm 16 is attached laterally at the contact arm 11, thus in a transition portion to the connection member 14, and supports the support arm 17. The support arm 17 extends parallel to a longitudinal central axis M of the contact arm 11 and is arranged offset and below the contact arm 11 through the connection arm 16. At its free end, the support arm 17 includes a support protrusion 18 which is oriented towards the contact arm 11.

Figure 1:
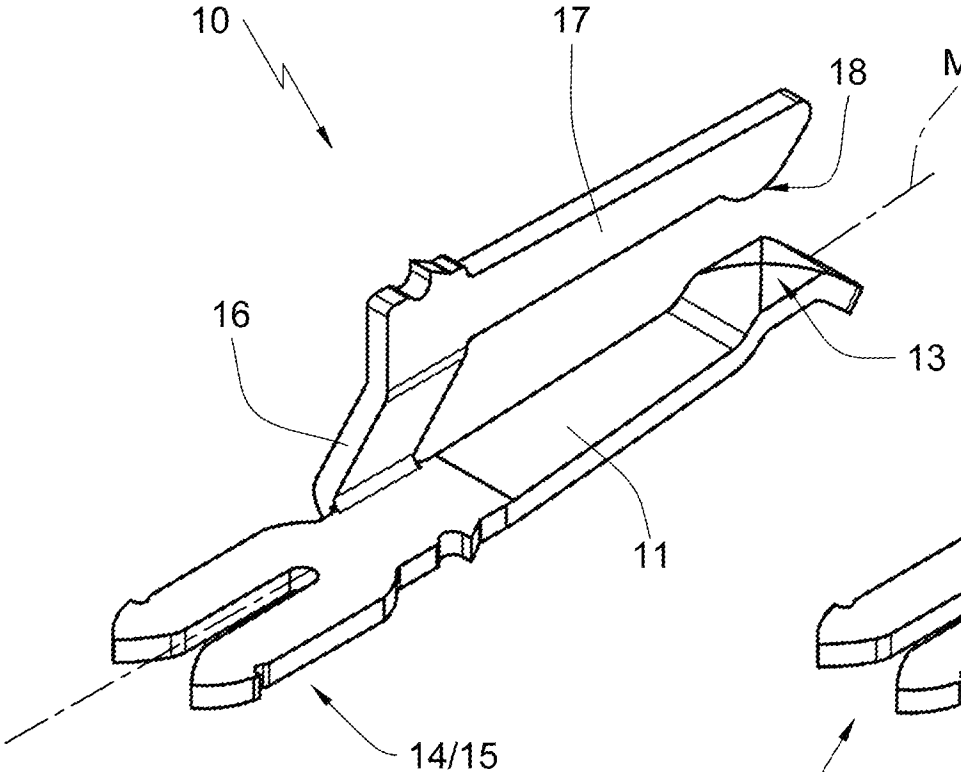
FIG. 1 illustrates an insertion contact according to the invention in a perspective view of the bottom side of the contact arm.

It is apparent from FIGS. 1 and 2 that the insertion contact 10 is configured as a stamped and bent component. The insertion contact 10 is made from a suitable electrically conductive flat material, in particular sheet metal and cut out with a stamping tool. Thus, the top side and the bottom side of the sheet metal form the so-called rolled sides, whereas the lateral surfaces created when disengaging through the stamping tool are designated as stamped sides or stamping edges. After the stamping process, the contact arm 11, the connection arm 16 and the support arm 17 are still arranged in a common plane.

Through respective bending processes, the stamped blank is folded up to form the insertion contact 10 as illustrated in FIGS. 1 and 2. The bottom side of the contact arm 11 is oriented towards the support arm 17; the top side of the contact arm 11 is oriented in the opposite direction. When folding up the contact 10, eventually also the contact protrusion 13 is produced by bending or embossing the contact arm 11.

Figure 4:
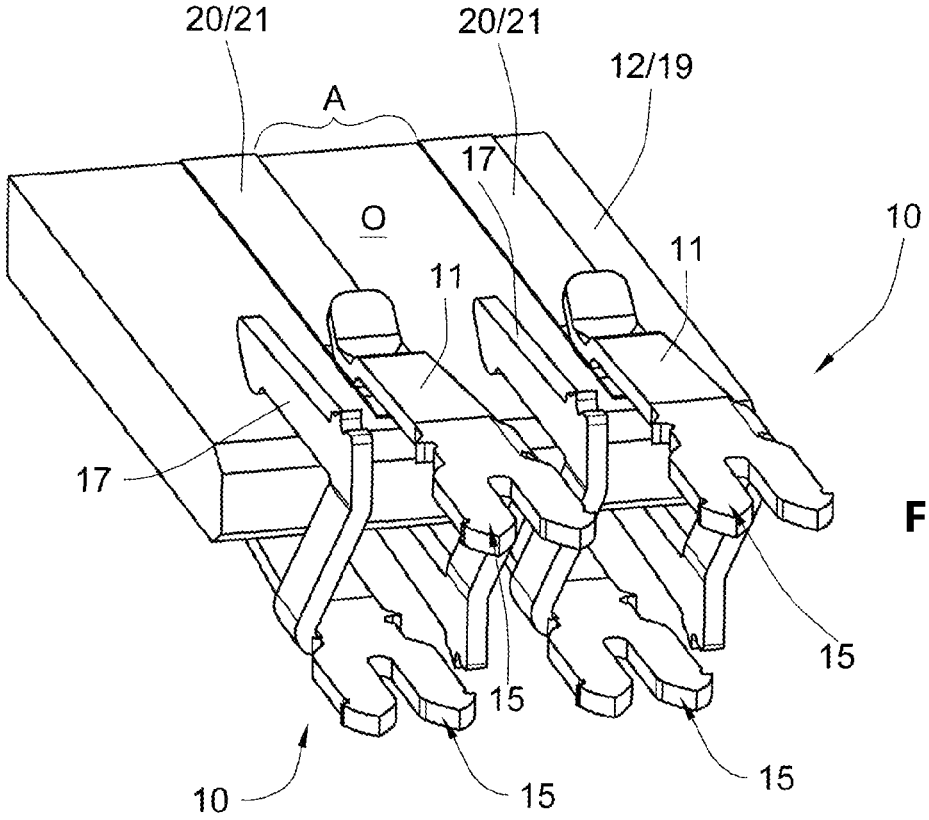
FIG. 4 illustrates a perspective view of FIG. 3 of a top side of the circuit board.
Figure 5:
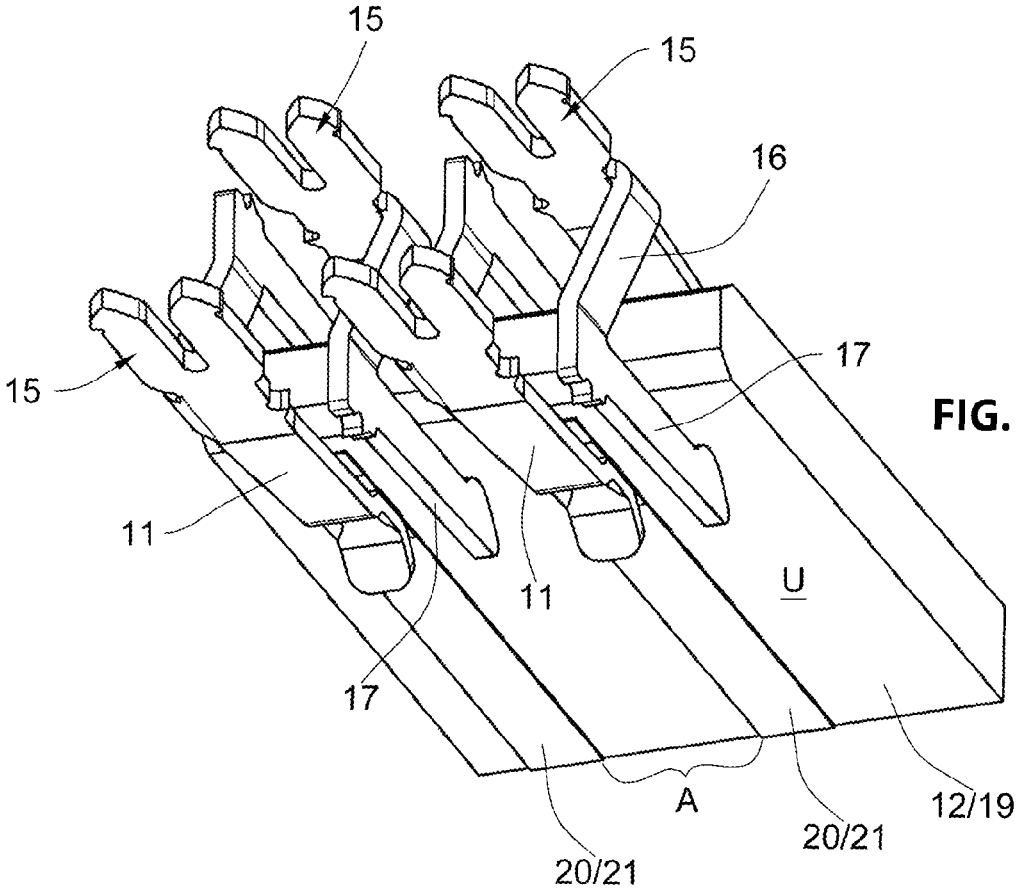
FIG. 5 illustrates a perspective view according to FIG. 3 of the bottom side of the circuit board.

In FIGS. 4 and 5, the contacts according to FIGS. 1 and 2 are arranged at a contact support 12, herein configured as a conductor plate 19. The opposite contacts 20 are formed by the conductive paths 21 which are applied to the circuit board 19. As apparent from the comparison of FIGS. 4 and 5, the conductive paths 21 are applied on the top side O and also on the bottom side U of the circuit board 19 and have a uniform distance A from one another. The uniform distance A corresponds to the grid pitch which provides the horizontal distance of two contact arm longitudinal center axes M of adjacent contacts 10, thus the distance of two contact protrusions 13 from one another.

It is shown that the insertion contacts 10 at the circuit board 19 are arranged opposed to one another. This means the contact arm 17 of a first insertion contact 10 contacts a conductive path 21 of a top side O of the circuit board 19. The contact arm 11 of the adjacent insertion contact 10, however, contacts a conductive path 21 of the bottom side U of the circuit board 19. Put differently, the support arm 17 of the first insertion contact 10 is arranged adjacent to the contact arm 11 of a second insertion contact 10. It furthermore becomes apparent that the contact arm 11 contacts the conductive path 21 with the rolled side of the contact arm, whereas the support arm 17 contacts the circuit board with the stamped side of the support arm 17.

Figure 3:
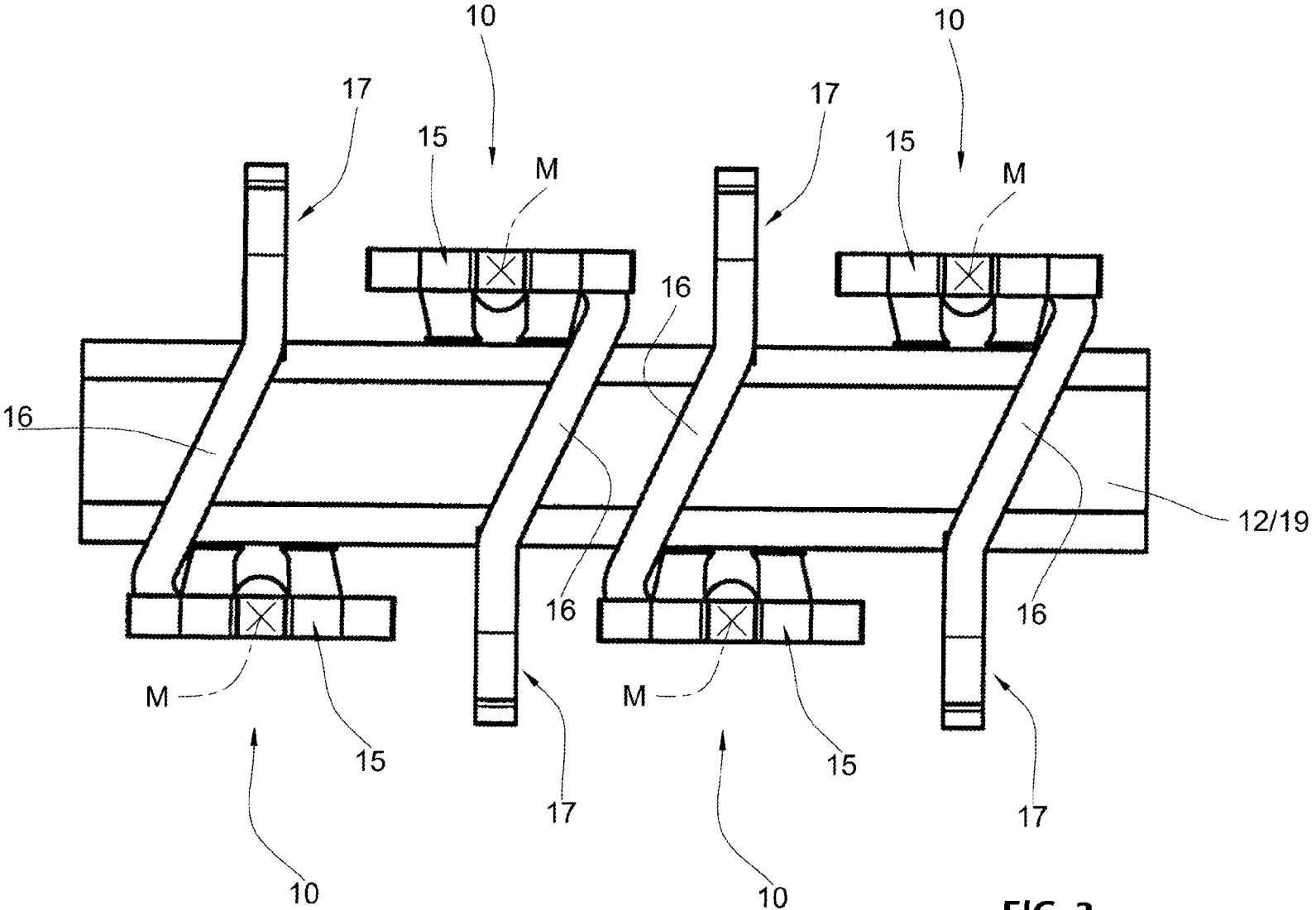
FIG. 3 illustrates a side view of an arrangement of contact arms according to FIG. 1 at a circuit board.

As apparent in from FIGS. 4 and 5, in particular, however, from FIG. 3 (a view of the narrow edge of the circuit board 19 according to FIGS. 4 and 5), the described opposite arrangement of plural insertion contacts 10 adjacent to one another facilitates significantly reducing the grid pitch, thus the distance of the longitudinal center axes M of two adjacent contacts from one another. The contacts 10 are arranged quasi-nested into one another, wherein the connection arm 16 is elbowed so that the support arm 17 is arranged in a plane including the longitudinal center axis M and arranged orthogonal to the rolled side of the contact arm 11. Consequently, the support arm 17 is arranged centrally below the contact arm 11, wherein the contact forces between the contact surfaces of the contact arm 11 and the conductive path 21 are evenly distributed.

Figure 8:
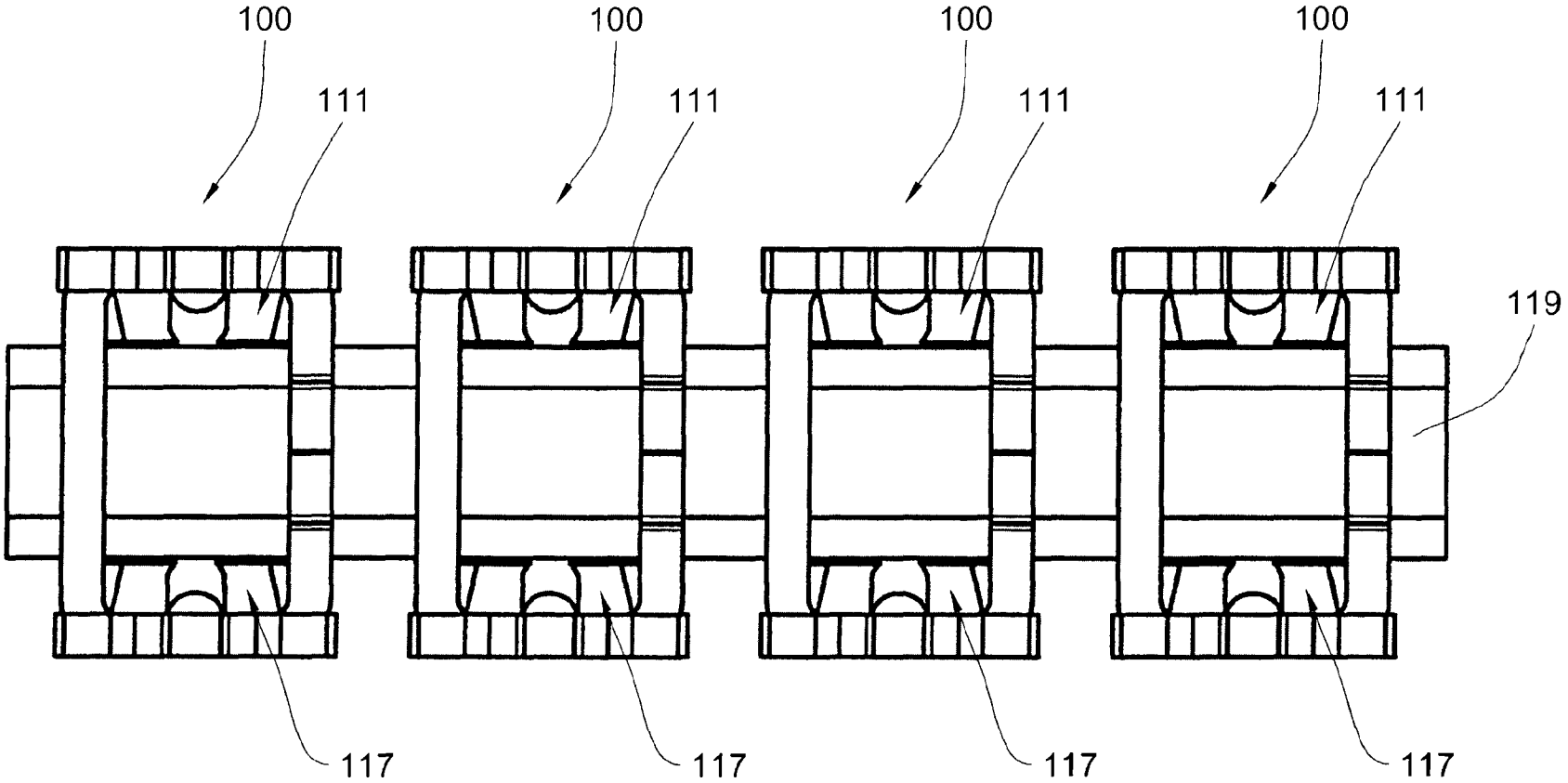
FIG. 8 illustrates an arrangement of known insertion contacts at a circuit board in a view according to FIG. 3.

In order to emphasize that the grid pitch is reduced relative to the known embodiments, a comparison between FIGS. 3 and 8 is used. In FIG. 8, known contacts 100 are inserted onto a circuit board 119. In the known contacts 100, the contact arm 111 and the support arm 117 are configured identical and contact the circuit board 119 with their rolled sides. Thus, the support arm 117 uses the same surface portion of the circuit board as the contact arm 111. Therefore, the known grid pitch is higher by at least half the width of the support arm than for using contacts 10 according to the present invention.

Figure 6:
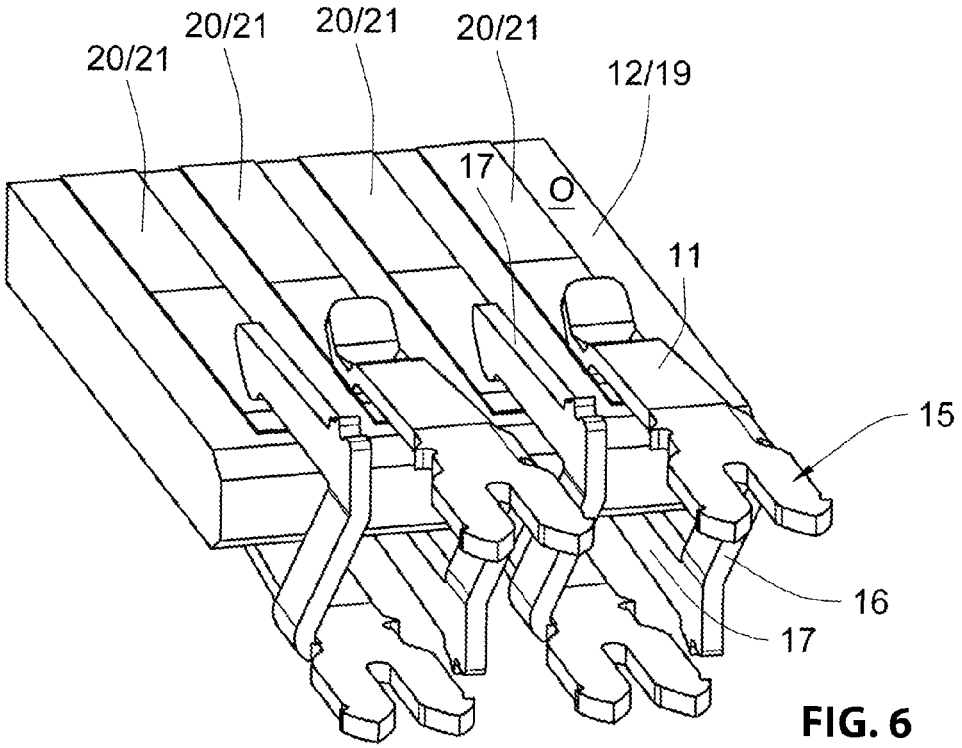
FIG. 6 illustrates a perspective view according to FIG. 4 with electrical contacting of the insertion contacts on both sides.
Figure 7:
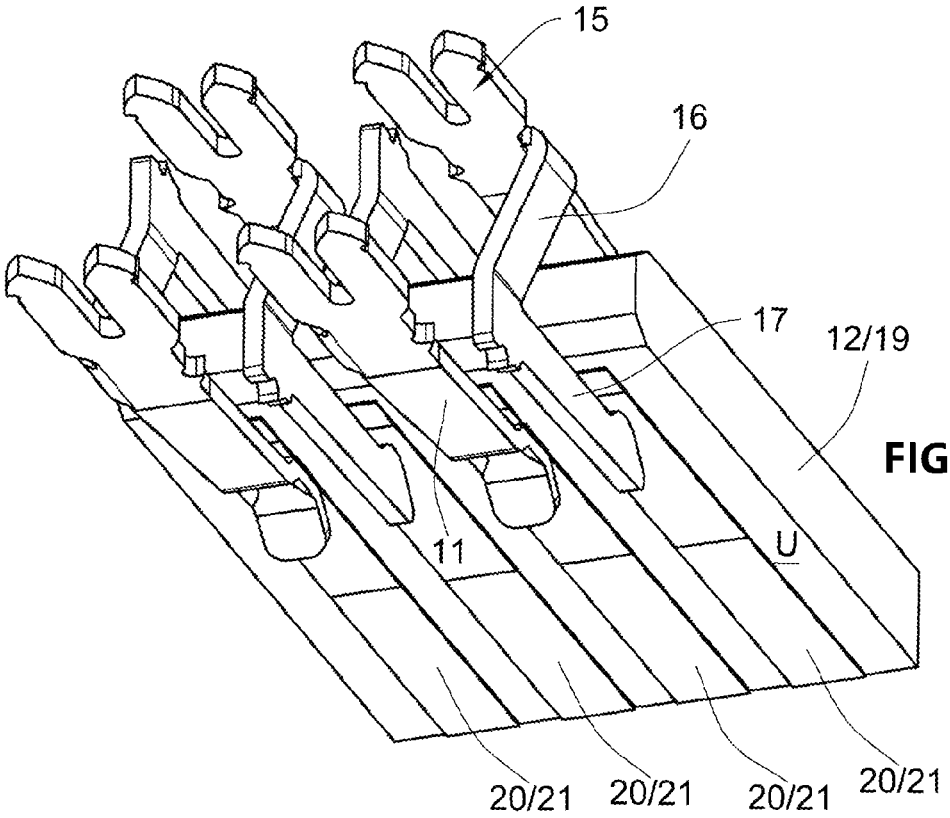
FIG. 7 illustrates a perspective view according to FIG. 5 with electrical contacting of the insertion contacts on both sides.

For the sake of completeness it is illustrated in FIGS. 6 and 7 that the contacts 10 according to the invention also facilitate double sided contacting of opposite contacts 20 of a contact support 12 while maintaining the reduced grid pitch, so that conductive paths 21 of a circuit board 19 are contacted. Thus, only the number of conductive paths 21 on the top side O and on the bottom side U have to be doubled in view of the reduced grid pitch so that in addition to the contact arm 11 that contacts on the rolled side, also the support arm 17 that contacts on the stamped side contacts a conductive path 21.

Depending on the arrangement of the support arm 17 relative to the contact arm 11, a substantial reduction of the grid pitch is feasible while maintaining predetermined technical specifications when using the insertion contact 10 according to the invention instead of the known contacts 100.

REFERENCE NUMERALS AND DESIGNATIONS

10 insertion contact
11 contact arm
12 contact support
13 contact protrusion
14 connecting member
15 cutting fork
16 connection arm
17 support arm
18 support protrusion
19 circuit board
20 opposite contacts
21 conductive paths
100 contact
111 contact arm
117 support arm
119 circuit board
A distance of 21
M longitudinal center axis of 11
O top side
U bottom side

What is claimed is:

1. An insertion contact for arrangement at a contact support including an opposite contact, the insertion contact comprising:

a contact arm which contacts a first contact surface of an opposite contact in an electrically conductive manner which opposite contact is arranged on a top side of a contact support;

a support arm which contacts a bottom side of the contact support; and a connection arm which arranges the contact arm at the support arm, wherein the contact arm and/or the support arm is deflectable in a spring elastic manner, wherein the insertion contact includes a connection member for connecting a conductor, wherein the insertion contact is configured as a stamped component, wherein the contact arm of the insertion contact contacts the first contact surface of the opposite contact with a rolled side of the contact arm, and wherein the support arm contacts the bottom side of the contact support with a stamped edge of the support arm.

2. The insertion contact according to claim 1, wherein the connection arm is arranged at an edge of the contact arm and oriented orthogonal to the contact arm.

3. The insertion contact according to claim 1, wherein the connection arm is configured elbowed and the support arm arranged at the connection arm is arranged parallel to a longitudinal center axis of the contact arm and centrally below the contact arm.

4. The insertion contact according to claim 1, wherein the contact arm supports the connection member, in particular a cutting fork.

5. The insertion contact according to claim 1, wherein the opposite contact forms a second contact surface at a bottom side of the contact support, wherein the second contact surface is electrically connected with the support arm.

6. An arrangement with at least two insertion contacts according to claim 1, at a contact support, the contact support comprising:

at least one first opposite contact which forms a first contact surface on a top side of the contact support; and at least one second opposite contact which forms a second contact surface on a bottom side of the contact support, wherein the first contact surfaces on the top side of the contact support and the second contact surfaces on the bottom side of the contact support are respectively arranged at fixed uniform distances from one another, wherein the contact arms of the insertion contacts are arranged in opposite orientations at the contact support, so that a first insertion contact contacts the first contact surface of the first opposite contact on the top side of the contact support with the contact arm of the first insertion contact and the second insertion contact contacts the second contact surface of the second opposite contact on the bottom side of the contact support with the contact arm of the second insertion contact.

7. The arrangement according to claim 6, wherein the second contact surfaces on the bottom side of the contact support are arranged offset relative to the first contact surfaces on the top side of the contact support by a predetermined fraction of either distance.

8. The arrangement according to claim 7, wherein a distance of the first contact surfaces from one another on the top side of the contact support and a distance of the second contact surfaces from one another on the bottom side of the contact support is identical, wherein the offset corresponds to 0.5 times the distance.

9. The arrangement according to claim 6, wherein a distance of the first contact surfaces from one another on the top side of the contact support and a distance of the second contact surfaces from one another on the bottom side of the contact support is identical.

* * * * *